US006637940B1

(12) United States Patent
Metz

(10) Patent No.: US 6,637,940 B1
(45) Date of Patent: Oct. 28, 2003

(54) CURVED TEAR GUIDE ON TUBULAR PACKAGINGS

(76) Inventor: Michael Metz, Alte Weinsteige 18, D-70180 Stuttgart (DE)

( * ) Notice: Subject to any disclaimer, the term of this patent is extended or adjusted under 35 U.S.C. 154(b) by 0 days.

(21) Appl. No.: 09/830,799

(22) PCT Filed: Oct. 29, 1999

(86) PCT No.: PCT/EP99/08218

§ 371 (c)(1),
(2), (4) Date: Aug. 27, 2001

(87) PCT Pub. No.: WO00/26110

PCT Pub. Date: May 11, 2000

(30) Foreign Application Priority Data

Oct. 29, 1998 (DE) ..... 298 19 338 U
Apr. 30, 1999 (DE) ..... 299 07 729 U

(51) Int. Cl.[7] ..... B65D 33/00
(52) U.S. Cl. ..... 383/200; 426/112
(58) Field of Search ..... 206/484, 527; 383/200, 202, 204, 209; 426/112, 122

(56) References Cited

U.S. PATENT DOCUMENTS 2,992,118 A * 7/1961 Daline ..... 383/202
3,397,835 A * 8/1968 Henning ..... 383/200
3,815,810 A * 6/1974 Wellman ..... 383/204
3,882,999 A * 5/1975 Wellman ..... 383/202
5,544,469 A * 8/1996 Weder et al. ..... 53/410
5,593,229 A * 1/1997 Warr ..... 383/209
6,139,187 A * 10/2000 Galomb et al. ..... 383/204

FOREIGN PATENT DOCUMENTS

| | | | |
|---|---|---|---|
| DE | 197 06 825 | * | 9/1998 |
| EP | 0012275 | * | 6/1980 |
| GB | 1015383 | * | 12/1965 |
| WO | WO90/11946 | * | 10/1990 |

* cited by examiner

*Primary Examiner*—Jim Foster
(74) *Attorney, Agent, or Firm*—Susan M. Schmitt

(57) ABSTRACT

The invention relates to tubular packaging, especially for dry food stuff, which contains the product in a plastic tube that is closed by welding, whereby the packaging comprises a tearing aid which is located in the area of a weld seam. The packaging is also provided with a label whose side facing the weld seam is configured as a curved tearing edge which is suited for intercepting a tear, said tear starting from the tearing aid, and for guiding the same to the edge of the packaging.

20 Claims, 4 Drawing Sheets

CURVED TEAR GUIDE ON TUBULAR PACKAGINGS

BACKGROUND OF THE INVENTION

Field of the Invention

The invention relates to a flexible tubular package, which is more particularly suitable for foodstuffs in the form of lumps or portions and contains the respective product in a welded flexible plastic tube.

Flexible tubular packages are conventional in many fields for the packaging of foodstuffs and the like. This more particularly applies for foodstuffs in a lump form or in the form of small portions, which are intended to be consumed in portions, be it as a staple foodstuff as an ingredient for the preparation of meals or as a snack for immediate consumption. Flexible tubular packages are simple to produce and to fill, are readily stored and handled, offer effective protection for the packaged foodstuff and make it possible to label the foodstuff either directly on the flexible tubular material or using adhesive labels.

Requirements as regards hygiene are fulfilled to their full extent.

Flexible, tubular packages as a rule comprise a tubular foil, whose two ends are sealed by bonding or by welding. The packaged material is then protected against the effects of the surroundings in an optimum manner. For removal of the contents it is necessary for the package to be ripped or cut open. If scissors are not to hand, ripping open is the only possibility, which generally starts at one of the welded sides. Frequently, aids to ripping open are provided, as for instance in the form of a rip thread incorporated in the material, or a notch which serves for starting the ripping operation. However, even with a notch the ripping action may get out of control so that the flexible tubular package is torn open to a greater length than really intended. It is possible to assume that in many or even in the majority of cases, the tearing open operation does not result in an opening which has the desired size.

The consequences can be inconvenient, more particularly in the case of liquid contents of the package.

Designs with a sort of ruler incorporated in the package have been suggested for plastic bags. However there is then no control of the opening operation and frequently the tear goes astray.

If contents of the package are intended for immediate consumption, then there are relatively few problems. Problems do occur when only part of the package contents are to be removed and consumed whereas the remainder is to be kept and stored in the package. In this case a relatively small opening is desirable whose size is set by the size of one piece or lump of the contents of the package. Such an opening with a set size is also desirable for hygiene reasons. On the contrary however for reasons of handling the opening must not be too small.

SUMMARY

One object of the invention is accordingly the creation of a flexible tubular package rendering possible the provision of an opening of a predetermined size in line with the size of the foodstuff packed in the package. The opening is to be able to be made without external means by ripping open by hand in a reliable manner while leaving the container intact so that storage of the remaining contents is readily possible.

This aim is to be attained with a package of the type initially mentioned which adjacent to a welded seam possesses a rip open means and is provided with a stick on means, whose edge adjacent to the welded seam is in the form of a curved tear off edge, which is able to control a tear, which extends from the tear open means, and to direct it to the edge of the package.

The flexible tubular package of the invention is more particularly suitable for foodstuffs, which are intended as provisions on a journey. These will include for instance bars of chocolate, muesli, vegetable substances or fruits, which are intended as snacks while under way, as a school break or also as "energy ration" for examinations, discussions or quite generally as a snack between meals during work. Here conventional snacks such as nuts, peanuts, potato chips, flips, cookies, sweets or the like, come into question as well which are intended to be eaten in small portions or in a small number, while the remains in the already opened package. Finally, the tear open means is also suitable for packages with liquid or non-food articles. It is certainly not limited to the food sector.

The package in accordance with the invention is more especially suitable for use in conjunction with the package in accordance with the German patent publication (utility model) 29,715,892, which is intended to be stapled, together with an attachment means, on or in some object.

In the case of the flexible tubular package in accordance with the invention it is a question of a specially designed conventional package, whose two ends of the tube are sealed by a bonded or welded seam. In the case of such a flexible tubular package a stick-on sheet is provided, which on one of its edges adjacent to the welded seam has a curved rip edge. It will be clear that the stick-on sheet will consist of a suitably tear-proof material and more particularly paper or plastic. In order to ensure that the rip edge can perform its intended function, adjacent to the welded seam on the package there is, in a zone directly contiguous to, and running toward the rip edge a tear open means, as for instance in the form of a notch or a cut. This tear open means naturally does not extend as far as the interior of the package and in fact terminates in the welded zone. Many flexible tubular packages are toothed or ridged at their sealing weld seam which may be readily utilized as a tear open means. In this case it is convenient to mark the point where the tear is to be started in color.

The tear open means is, when the package is held upright—with the weld seam at the top end—above the curved rip edge of the stick-on sheet. The stick-on sheet is accordingly arranged at a comparatively small distance from the welded seam, for instance at a distance of 0.2 to 5 cm. The distance is in this respect dependent on the size of the package and of the stick-on sheet and furthermore on the size of the opening to be produced in the package.

The rip edge assumes a curved in the form of and is suitable for a tear starting at the tear open means and directing such tear to the edge of the package. More especially the curved form in this case ensures that the rip edge and the direction of the tear are always at a convenient acute angle to one another. Straying of the tear from the desired course will not occur.

In accordance with a preferred development of the invention the stick-on sheet may be trained around the edge of the package, it being in this case expedient for it to extend on the rear side in alignment with the front side. The modification of the design is more particularly convenient in the case of packages with lateral gussets.

A stick-on sheet trained around the edge of the flexible tubular package, and more particularly in the form of a strip, makes a substantial contribution to stabilizing the opening part of the package. This renders possible the use of thinner foils or, respectively, of foils of other, less tear resistant materials.

It is convenient for the rip edge to have an S-like and more particularly a sinusoidal course, the curve drawing close to the edge of the stick-on sheet in the top part, that is to say in the part adjacent to seam, it running toward a lateral edge of the stick-on sheet at the other end.

The amplitude of the rip edge with such a sinusoidal form will then conveniently amount to 10 to 20% of the length of the curve. The curve will more particularly extend about an axis, which intersects the sides of the stick-on sheet at an angle of 120 to 1500 and more particularly 135°. An angle of intersection of with the two edges of the stick-on sheet will then, as related to the triangle formed by the axis and the missing limbs of the stick-on sheet, an isosceles triangle.

More particularly in the case of stick-on sheets in the form of labels it is particularly convenient for the S-like curve, which draws close to the top edge and, respectively, the side adjacent to the weld seam of the stick-on sheet, to terminate on the respectively adjacent side generally at a right angle to the edge.

Another preferred feature of the invention is such that the rip edge is formed by a cutout in the corner part of the stick-on sheet, such cutout being in the form of a quadrant of a circle.

The stick-on sheet my be in the form of a conventional label, which at the edges adjacent to the side to be torn open has a suitable configuration. As an alternative it may however also be a question of a suitably curved strip of paper or plastic, which does not have to perform any other functions. In the case of the use of transparent plastic foil the stick-on sheet will hardly be seen on the package. Printing it is also possible.

In the case of the tear open means it will for instance be a question of notches in the weld seam. It may be a question as well of a plurality of pits, as are utilized as a zig-zag edge in the case of such flexible tubular packages. In this case it may be convenient to mark a notch or pit, placed particularly suitably adjacent to the rip edge, for instance by coloring it. Convenient tear open threads welded into the material are also suitable.

Finally the invention relates to a stick-on sheet or, respectively, a label able to perform the function of providing rip edge for the above described flexible tubular package and comply with the above definition. Finally the invention also relates to flexible tubular packages designed on these lines with the goods therein, in the case of which it may be a question of goods which are not intended for the foods sector, and may be lumps or tabs of fertilizer, detergents or dish washing materials.

The invention will now be explained in detail with reference to the accompanying drawings.

DETAILED DESCRIPTION OF THE DRAWINGS

DETAILED DESCRIPTIONS

Figure 1:
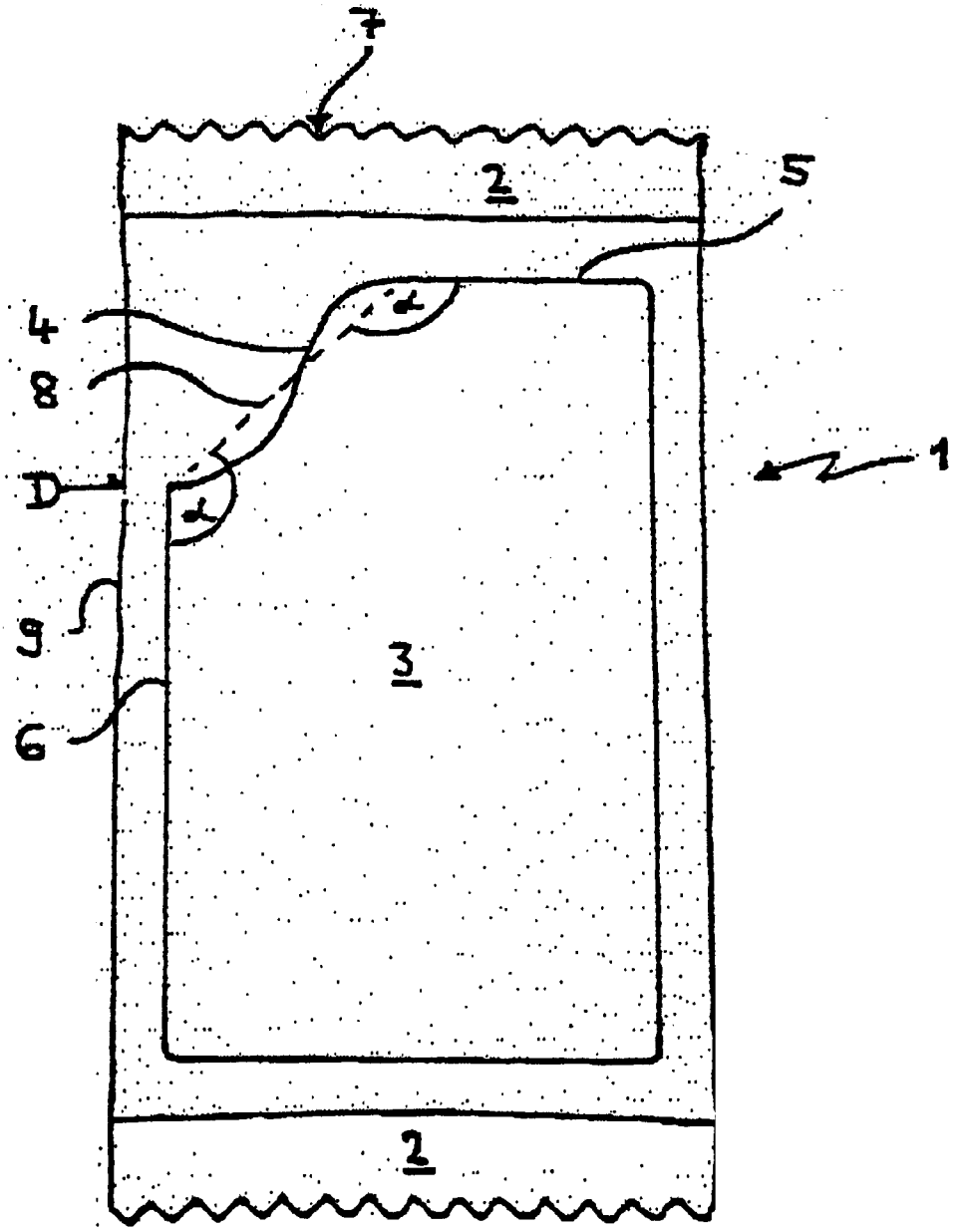
FIG. 1 shows a flexible tubular package in accordance with the invention having a tear open means and a stick-on sheet.

FIG. 1 shows a preferred embodiment of a flexible tubular package in accordance with the invention provided with a label arranged thereon. The flexible tubular package 1 itself comprises a tubular foil part, which at its two ends is sealed by welds or bonded seams. It will be clear that the term "weld" employed herein may include other seals, such as bonded seams. The label 3 is located on the flexible tubular package and adjacent to the welded seam 2 and has a top edge 5 and a lateral edge 6 adjacent to it. Where the edges 5 and 6 merge together there is the rip edge 4, which firstly extends from the top edge 5 in a curve toward the inside part of the label and then extends along an oppositely directed curve toward the edge 6 of the label, which it meets essentially at a right angle. The S-like rip edge 4 generally has sinusoidal course around the axis 8, which intersects the label edges 5 and 6 at an angle of 135° and with the missing corner part of the label forms an isosceles triangle.

Adjacent to the weld seam 2 there are notches 7, which are designed a tear open means. The notches, which as related to the longitudinal direction of the flexible tubular package, are located above the rip edge 4, produce a tear on opening the package, which on running through the foil meets the rip edge 4 and extends from same toward the point D on the lateral edge 9 of the package 1. The opening produced in the flexible tubular package in accordance with the invention therefore extends from the tear open point 7 above the rip edge 4 toward the latter and then on further to the end point D on the package 1 and thence back to the point 7 of tearing open, and therefore leads to a predetermined opening of a given size.

Figure 2:
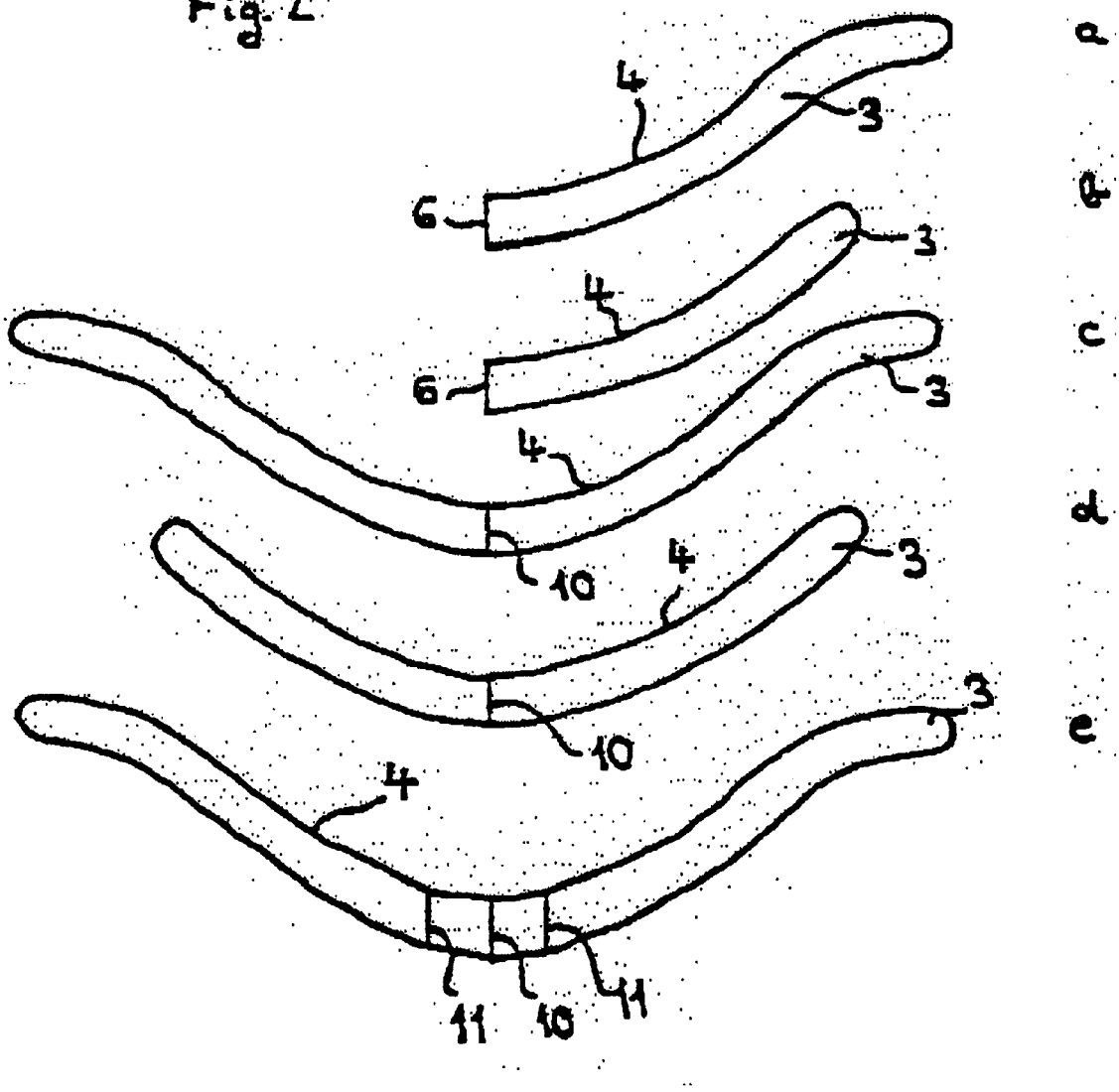
FIG. 2 shows modified forms of strip-like stick-on sheets.

FIG. 2 shows different stick-on sheets 3 in a srtip-like design, whose edge 4 adjacent to the tear open side of the package has a curvature leading to the desired shape of curve. The further modifications a, c and e have an elongated S-like shape, whereas the designs b and d have a plain curvature convex toward the tear open side. The modifications c through e are intended to be arranged around the side edge of the package on the front and rear sides. The modification 3 is to be arranged on packages with gusset-like seams at the sides. Reference numeral 6 indicates the lateral edge of the stick-on sheet, whereas reference numerals 10 and stand for gussets for adaptation to the edge and suitable gussets on packaging bags.

Figure 3:
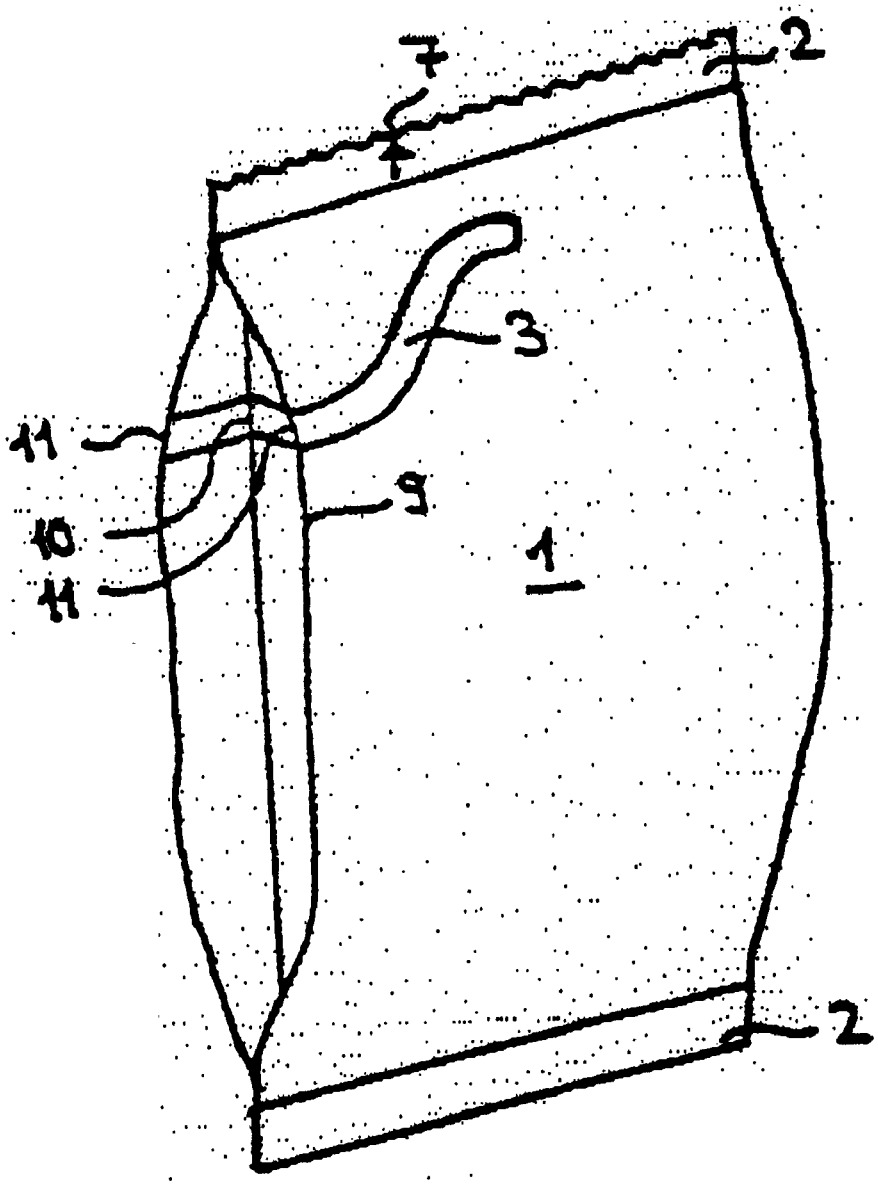
FIG. 3 shows a gusseted flexible tubular package having a stick-on sheet and a tear open means.

FIG. 3 shows a laterally gusseted bag 1 with top and bottom seals 2 and a tear open means 7. The stick-on sheet 3 is provided with a rip edge 4 near the top edge of the bag and is trained about the lateral edge 9 of the bag at an additional gusset 12. The stick-on sheet 3 is arranged on either side of the bag in a flush manner.

Figure 4:
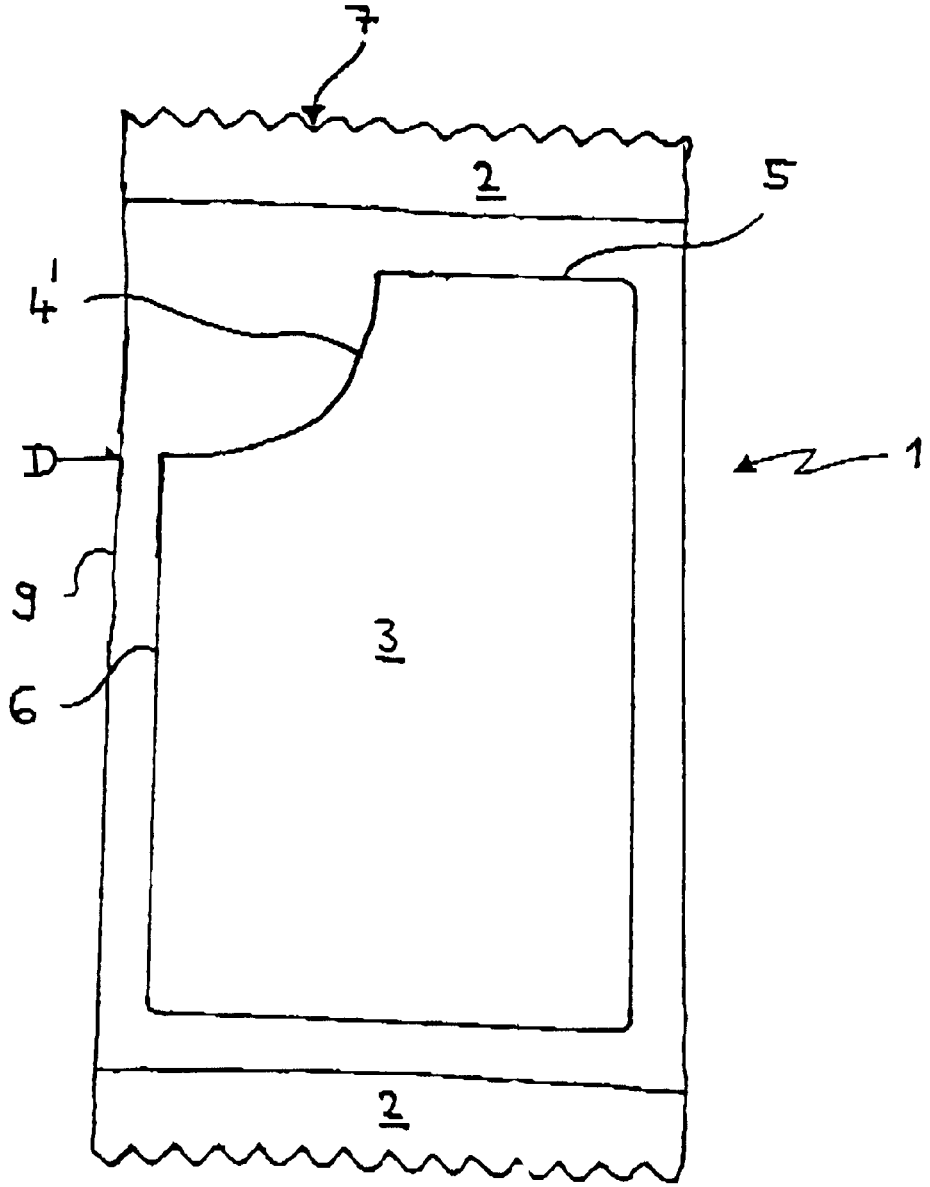
FIG. 4 shows the tubular package in FIG. 1 with a stick on sheet having a rip edge constituted by a cutout in the form of a circular quadrant.

FIG. 4 illustrates the package 1 of FIG. 1 with a stick-on sheet 5' having a rip edge 4' constituted by a cutout in the form of a circular quadrant.

The stick-on sheet in accordance with the invention with the curved rip edge may be provided both on one side of a flexible tubular package and also on either side thereof. It can be so arranged that essentially the entire side of the package is opened or however only a section thereof. The integration of the of a closure strip having self-adhesive strips, and which may also be provided with a holding tag, is readily possible. Such a closure may be then stuck on around the end to be opened of the package and then onto the rear side.

What is claimed:

1. A flexible tubular package, for a product, which contains the product in a flexible tube closed by welding, comprising a flexible tube; a weld seam; a tear open means for tearing open the package, the tear open means being positioned adjacent to the weld seam; an edge of the package; and a stick-on sheet including a side in the form of a curved rip edge, which is adapted to direct a tear, which starts at the tear open means, to the edge of the package, wherein the curved rip edge comprises a cutout in the form of a circular quadrant in a corner part of the stick-on sheet and extending essentially perpendicular to the edge of the package.

2. The flexible tubular package as claimed in claim 1, characterized in that the stick-on sheet is trained around the edge of the flexible tubular package.

3. The flexible tubular package as claimed in claim 1, characterized in that the stick-on sheet is a label.

4. The flexible tubular package as claimed in claim 1, characterized in that the stick-on sheet is a stretched tubular strip of a transparent plastic material.

5. The flexible tubular package as claimed in claim 1, characterized in that the tear open means is a notch or a weakened area in a welded seam.

6. The flexible tubular package as claimed in claim 1, characterized in that the tear open means is marked in color.

7. A stick-on sheet for a flexible tubular package as claimed in claim 1, more particularly in die form of a label.

8. The flexible tubular package as claimed in claim 1 wherein the product comprises foodstuff.

9. A flexible tubular package, for a product, which contains the product in a flexible tube closed by welding, comprising a flexible tube; a weld seam; a tear open means for tearing open the package, the tear open means being positioned adjacent to the weld seam; an edge of the package; and a stick-on sheet including a side in the form of a curved rip edge, which is adapted to direct a tear, which starts at the tear open means, to the edge of the package, wherein the curved rip edge has an elongated S-like shape.

10. The flexible tubular package as claimed in claim 9, characterized in that the rip edge of the stick-on sheet has a sinusoidal shape.

11. The flexible tubular package as claimed in claim 10, characterized in that in its form the rip edge has an amplitude which is equal to 10 to 20% of the length of the curve.

12. The flexible tubular package as claimed in claim 10, characterized in that the rip edge extends around an axis intersecting the edges of the stick-on sheet at an angle of approximately 120° to 150°.

13. The flexible tubular package of claim 12 wherein the angle is about 135°.

14. The flexible tubular package as claimed in claim 9, characterized in that the stick-on sheet is trained around the edge of the flexible tubular package.

15. The flexible tubular package as claimed in claim 9, characterized in that the stick-on sheet is a label.

16. The flexible tubular package as claimed in claim 9, characterized in that the stick-on sheet is a stretched tubular strip of a transparent plastic material.

17. The flexible tubular package as claimed in claim 9, characterized in that the tear open means is a notch or a weakened area in a welded seam.

18. The flexible tubular package as claimed in claim 9, characterized in that the tear open means is marked in color.

19. A stick-on sheet for a flexible tubular package as claimed in claim 9, more particularly in die form of a label.

20. The flexible tubular package as claimed in claim 9 wherein the product comprises foodstuff.

* * * * *